US010344488B2

(12) United States Patent
Bridges

(10) Patent No.: US 10,344,488 B2
(45) Date of Patent: Jul. 9, 2019

(54) DEMOLITION TOOL

(71) Applicant: Apex Brands, Inc., Apex, NC (US)

(72) Inventor: Tobias McKay Bridges, Holly Springs, NC (US)

(73) Assignee: Apex Brands, Inc., Apex, NC (US)

( * ) Notice: Subject to any disclaimer, the term of this patent is extended or adjusted under 35 U.S.C. 154(b) by 324 days.

(21) Appl. No.: 15/306,875

(22) PCT Filed: Feb. 27, 2015

(86) PCT No.: PCT/US2015/017948

§ 371 (c)(1),
(2) Date: Oct. 26, 2016

(87) PCT Pub. No.: WO2015/167660

PCT Pub. Date: Nov. 5, 2015

(65) Prior Publication Data

US 2017/0051521 A1 Feb. 23, 2017

Related U.S. Application Data

(60) Provisional application No. 61/986,416, filed on Apr. 30, 2014.

(51) Int. Cl.

| | |
|---|---|
| ***B25G 3/38*** | (2006.01) |
| ***B25B 23/00*** | (2006.01) |
| ***B25B 27/04*** | (2006.01) |
| ***B25C 11/00*** | (2006.01) |
| ***B66F 15/00*** | (2006.01) |

(Continued)

(52) U.S. Cl.

CPC ..... *E04G 23/006* (2013.01); *B25B 27/04* (2013.01); *B25C 11/00* (2013.01); *B25G 3/38* (2013.01); *B66F 15/00* (2013.01); *E04G 23/08* (2013.01); *B25B 23/0028* (2013.01); *E04G 2023/085* (2013.01)

(58) Field of Classification Search

CPC ..... B66F 15/00; B66F 19/00; B66F 19/005; B25C 11/00; E04G 2023/085

See application file for complete search history.

(56) References Cited

U.S. PATENT DOCUMENTS

| | | | | |
|---|---|---|---|---|
| 326,909 A * | 9/1885 | Kricker | ..... | B25B 7/02 7/126 |
| 2,625,370 A * | 1/1953 | Huggins | ..... | A01B 1/04 254/131.5 |
| 2,680,003 A | 6/1954 | Feinstein | | |

(Continued)

FOREIGN PATENT DOCUMENTS

GB 2252544 A 8/1992

*Primary Examiner* — Tyrone V Hall, Jr.

(74) *Attorney, Agent, or Firm* — Coats & Bennett PLLC

(57) ABSTRACT

A demolition tool particularly adapted to aid in board removal. The tool includes a handle and a head. The head has outer forwardly extending arms and a central fastener puller. The central fastener puller is aligned with the handle so that undesired lateral torques are minimized on the handle during fastener removal. The central fastener puller may be formed on a central boss disposed between the two outer arms. The central boss advantageously includes a convexly curved lower surface that provides a central pry surface for the tool. The head may be selectively positionable relative to the handle, such as via a push-button locking pivot connection.

20 Claims, 7 Drawing Sheets

(51) Int. Cl.
*E04G 23/00* (2006.01)
*E04G 23/08* (2006.01)

(56) References Cited

U.S. PATENT DOCUMENTS

| | | | | |
|---|---|---|---|---|
| 2,863,635 | A | 12/1958 | Fandrich | |
| 3,049,337 | A | 8/1962 | Griggs | |
| D211,755 | S | 7/1968 | Yeager | |
| 4,658,489 | A * | 4/1987 | Johnston | B25B 27/00 29/268 |
| 5,176,363 | A | 1/1993 | Bowlin | |
| 5,423,114 | A | 6/1995 | Johnson | |
| 6,339,975 | B1 * | 1/2002 | Harpell | E04D 15/003 254/131.5 |
| 6,439,452 | B1 * | 8/2002 | Tsao | B65D 71/0022 229/120.15 |
| 6,530,559 | B1 * | 3/2003 | Pell | E04G 23/08 254/124 |
| 6,644,627 | B1 | 11/2003 | Forrester | |
| 7,520,199 | B2 * | 4/2009 | Stawarski | B25G 1/06 81/177.7 |
| 7,753,342 | B1 * | 7/2010 | Nolle | B25C 11/00 227/63 |
| 7,779,730 | B2 | 8/2010 | Jones | |
| 8,215,617 | B2 | 7/2012 | Liou | |
| 8,434,739 | B1 | 5/2013 | Connolly | |
| 2002/0134971 | A1 | 9/2002 | Christensen | |
| 2004/0149967 | A1 | 8/2004 | Puopolo et al. | |
| 2010/0207081 | A1 * | 8/2010 | Liou | B25D 1/00 254/129 |

* cited by examiner

DEMOLITION TOOL

This application claims the benefit of U.S. Provisional Application No. 61/986,416, filed 30 Apr. 2014, the disclosure of which is incorporated herein by reference in its entirety.

BACKGROUND

Numerous demolition tools have been proposed for aiding in the removal of boards, such as decking boards. Such tasks typically require the boards to be pried apart, and may require fasteners to be removed from the boards. However, the particular circumstances of the demolition, such as the configuration of the structure to be demolished, the available space, etc., may varying widely. While numerous demolition tools have been proposed, they have not proven satisfactory for all situations, and are often difficult to use for many applications. Thus, there remains a need for alternative designs of demolition tools, such as board removal tools.

SUMMARY

A demolition tool is described that is particularly adapted to aid in board removal. The tool includes a handle and a head. The head has outer forwardly extending arms and a central fastener puller. The central fastener puller is aligned with the handle so that undesired lateral torques are minimized on the handle during fastener removal. For some embodiments, the central fastener puller may be formed on a central boss disposed between the two outer arms. The central boss may advantageously include a convexly curved lower surface that provides a central pry surface for the tool. In some embodiments, the head is selectively positionable relative to the handle, such as via a push-button locking pivot connection.

In one or more embodiments, the demolition tool comprises a handle and a head. The handle has a proximal portion and a distal portion. The head is mounted to the distal portion of the handle. The head comprises first and second distally extending arms that are laterally spaced from each other. The head further comprises a first forward fastener puller disposed laterally between the first and second arms, with the first fastener puller having an entry slot that opens distally. The first forward fastener puller is laterally aligned with the handle.

The head may further comprise a central boss disposed between the first and second arms, and disposed in lateral alignment with the handle, and the first forward fastener puller may be disposed at the central boss. In some embodiments, the central boss has a convexly curved underside surface that extends below the first and second arms, with the curved underside providing a prying surface. In some embodiments, the first and second arms include laterally extending sections that extend toward the central boss, and the underside surface of the central boss is continuously curved, when viewed in side view, from distal to the laterally extending sections to proximal to the laterally extending sections. In some embodiments, the central boss further comprises a secondary rearward nail puller on an underside thereof.

In some embodiments, the head is movably mounted to the distal portion of the handle by a pivot connection that is operative to lockably position the head at a desired angular position relative to a longitudinal axis of the handle. The pivot connection may or may not include a push button actuator.

Of course, the present invention is not limited to the above features and advantages. Indeed, those skilled in the art will recognize additional features and advantages upon reading the following detailed description, and upon viewing the accompanying drawings. The various aspects discussed above and below may be used alone or in any combination.

DETAILED DESCRIPTION

Figure 1:
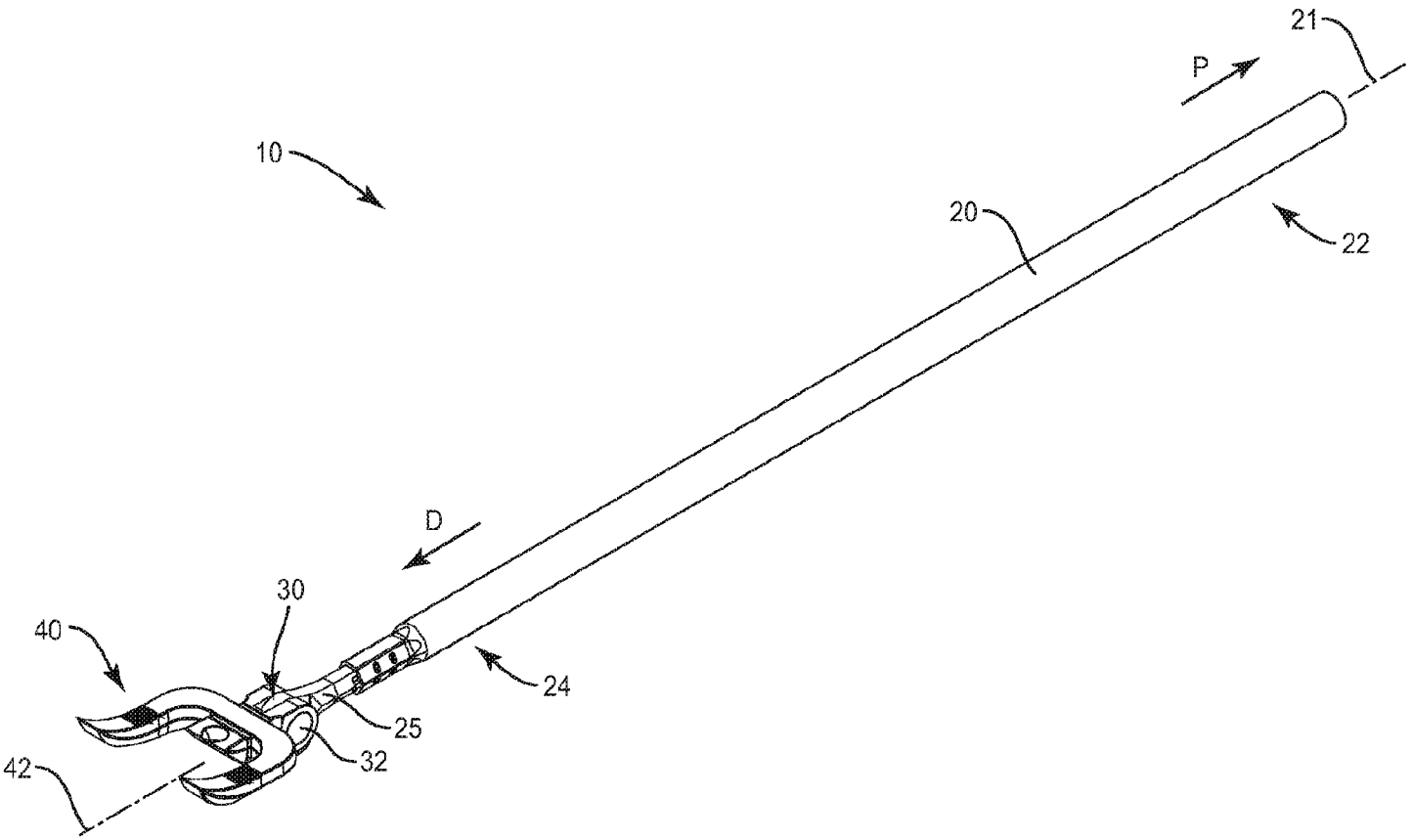
FIG. 1 shows a perspective view of a tool according to an embodiment of the present invention.

In one or more embodiments, the present application is directed to demolition tool particularly adapted to aid in board removal. The tool includes a handle and a head. The head has outer forwardly extending arms and a central fastener puller. For convenience, the fastener puller feature may be referred to as a nail puller; however, it should be understood that the fastener puller could also be used for screws, tacks, staples, and the like. The central nail puller is aligned with the handle so that undesired lateral torques are minimized on the handle during fastener removal. For some embodiments, the central nail puller may be formed on a central boss disposed between the two outer arms. The central boss may advantageously include a convexly curved lower surface that provides a central pry surface for the tool. In some embodiments, the head is selectively positionable relative to the handle, such as via a push-button locking pivot connection.

Referring to FIGS. 1-7, an exemplary demolition tool, generally indicated at 10, is generally fork-like and includes an elongate handle 20 and a working head 40. The handle 20 may take any form known in the art, such as the pole-like handle 20 illustrated with a proximal section 22 extending in a proximal direction P and a distal section 24 extending in a distal direction D. The handle 20 may advantageously extend straight along its longitudinal axis 21. However, in other embodiments, the handle 20 may have one or more bends or curves. For example, the handle 20 could extend straight along one plane of the longitudinal axis 21, but have one or more bends within that plane. As is conventional, the handle 20 may include suitable exterior texturing and/or grip material for enhanced gripping of the handle 20 by the user. In some embodiments, the handle may be telescopically adjustable in length.

Figure 3:
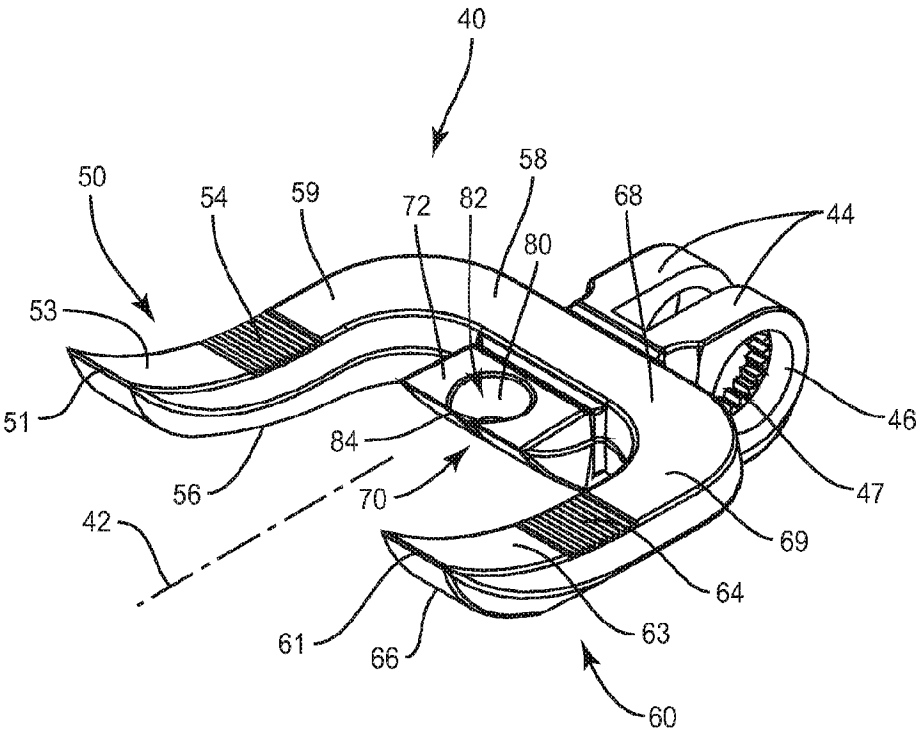
FIG. 3 shows a perspective view of one embodiment of a head of the tool of FIG. 1.
Figure 4:
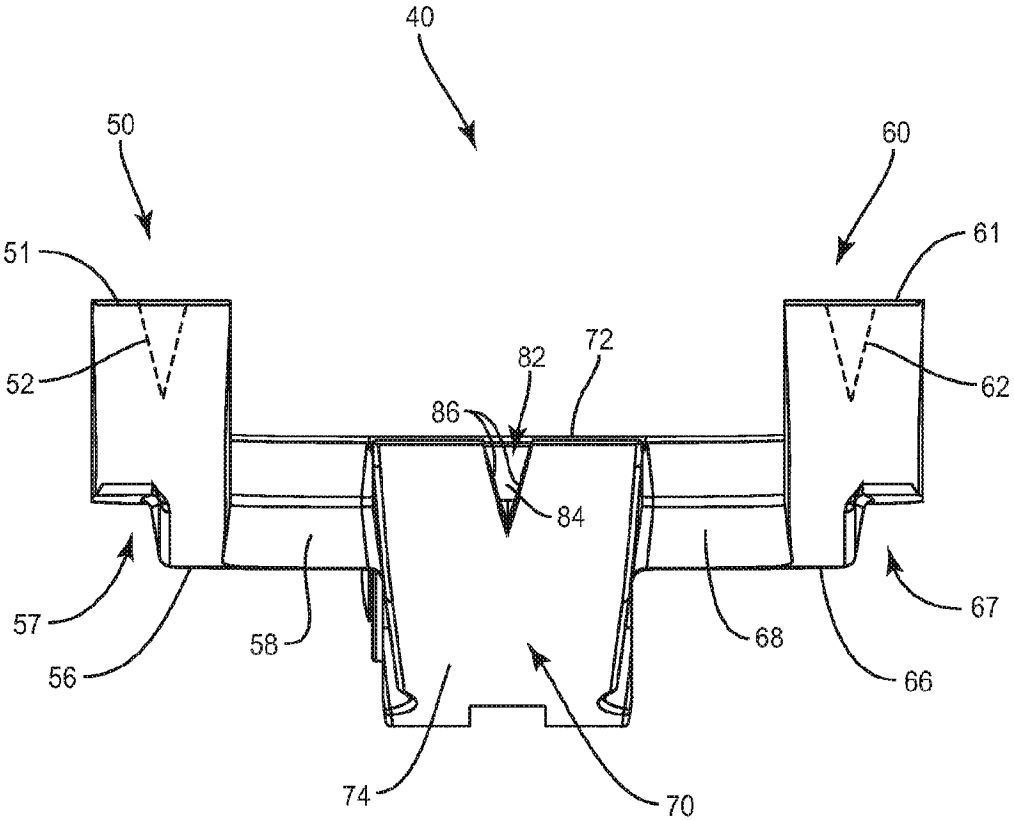
FIG. 4 shows front view of the head of FIG. 3.
Figure 5:
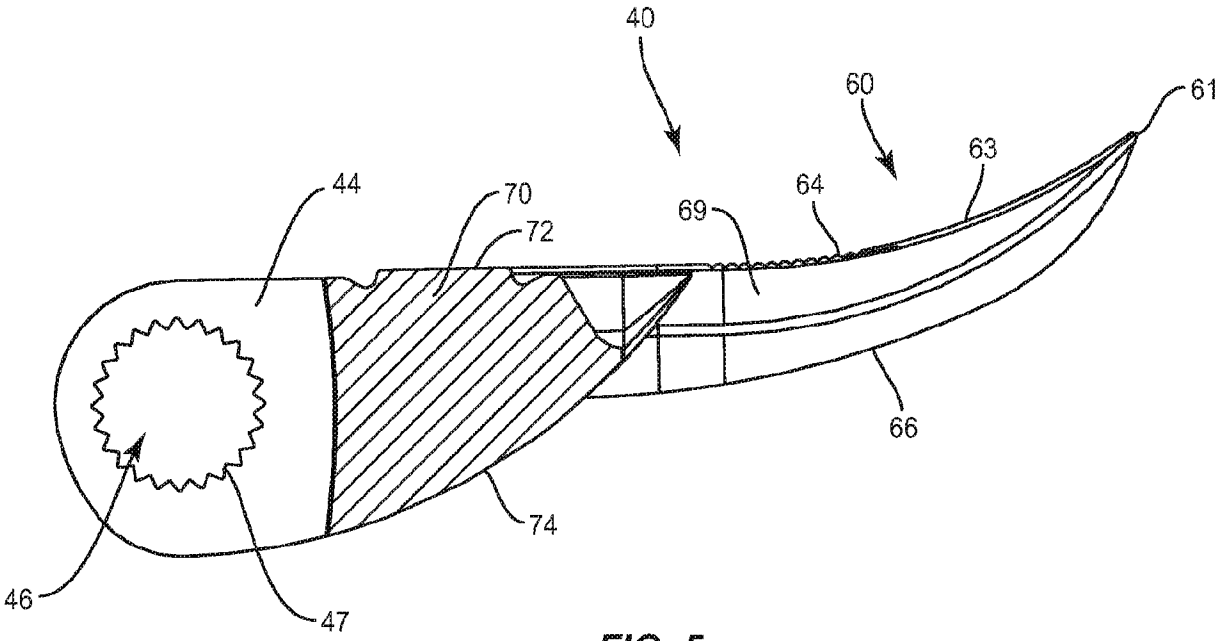
FIG. 5 shows a side cross-sectional view of the head of FIG. 3 along a central longitudinal plane.
Figure 6:
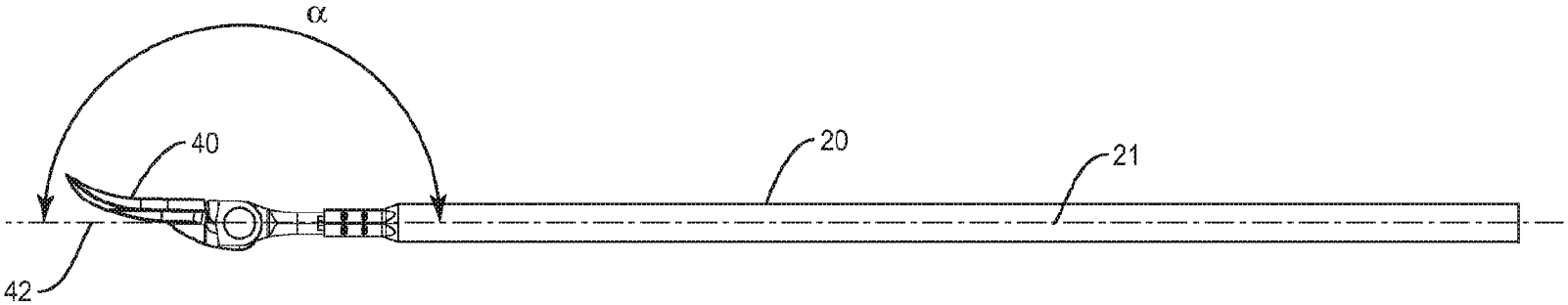
FIG. 6 shows a side view of the tool of FIG. 1, with the handle and head in a first angular configuration.
Figure 7:
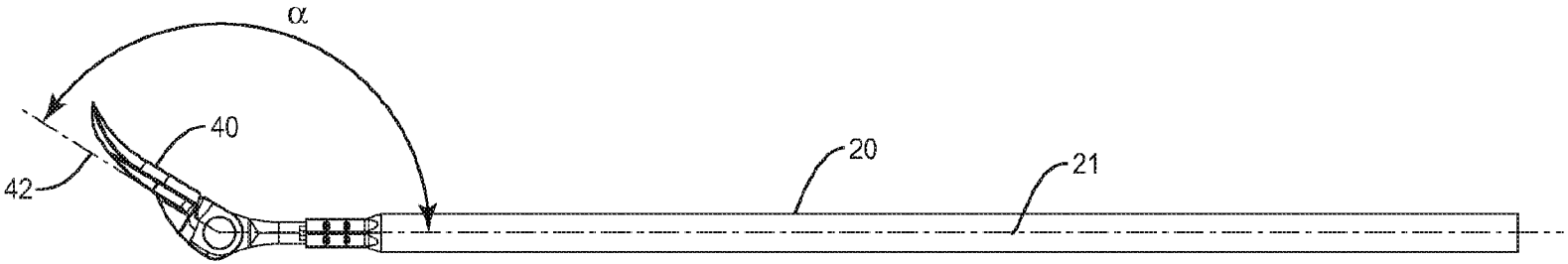
FIG. 7 shows a side view of the tool of FIG. 1, with the handle and head in a second angular configuration.

Referring more particularly to FIGS. 3-5, the head 40 has a forking configuration with a left arm 50 and a right arm 60 that are spaced from each other. Each arm 50,60 is generally L-shaped, with a laterally extending section 58,68 and a distally extending section 59,69. While not required, the upper surface 53,63 of the arms 50,60 advantageously each include textured areas 54,64 for better gripping of boards during the board prying process. In some embodiments, the textured areas 54,64 may take the form of one or more teeth, one or more ribs, knurling, or similar grip-enhancing surface structures. The distal portions of the arms 50,60 may be advantageously tapered and may optionally include terminal notches 52,62, so as to form fastener (e.g., nail) pullers. These optional notches 52,62 are shown in dashed lines in FIG. 4. The distal portions of the arms 50,60 may be upwardly curved or straight as is desired. In some embodiments, the underside 56,66 of the arms 50,60 include elongate recesses, or undercuts 57,67, on their outboard edges, to reduce weight. While not required, the left arm 50 and right arm 60 may be mirror images of each other.

In some embodiments, the head 40 further includes a central boss 70. The central boss 70 may advantageously have a generally flat upper surface 72, but a convexly curved lower surface 74, so that the distal tip of the central boss 70 is thinner than the proximal base of the central boss 70. In some embodiments, the lower surface 74 is continuously curved from a point well distal of the lateral sections 58,68 of arms 50,60 to a point well proximal of the lateral sections 58,68. For example, the lower surface 74 may be continuously curved from the tip of the central boss 70 to a point well rearward of the arms 50,60, as shown in FIG. 5. This curved lower surface 74 provides a central prying surface to aid in fastener extraction and/or board removal. The central boss 70 of the head 40 of FIGS. 3-5 includes a first or main nail puller 80 that includes a fastener head receiving cavity 82 or depression in the upper surface 72 and a forwardly (distally) and upwardly opening slot 84 that opens into the cavity 82. Using nails as an exemplary fastener, the heads of nails to be removed may be inserted into the cavity 82, with the shank of the nail extending through the slot 84. Note that slot 84 may have parallel sides, but advantageously has sides 86 that are laterally divergent in the upward direction, to facilitate insertion of a nail head into the cavity 82. In some embodiments, the central boss 70 may be as long or longer than the outer arms 50,60. However, the central boss 70 is advantageously significantly shorter than the outer arms 50,60, such that the outer arms 50,60 both extend distally farther than the central boss 70. While not required, the central boss 70 may directly connect the first arm 50 to the second arm 60, as illustrated in FIG. 3, where the lateral sections 58,68 of the arms 50,60 directly connect to the central boss 70. Alternatively, the central boss 70 and the arms 50,60 may each connect at a main portion of the head 40. Further, the upper surface 72 of the central boss 70 may advantageously not extend above the first and second arms 50,60 such that the upper surface 72 of the central boss 70 is not visible in side view. In some embodiments, the arms 50,60, central boss 70, and/or other portions of the head 40 are integrally formed from a suitable material, such as high-carbon steel or other suitable metal alloy.

Figure 2:
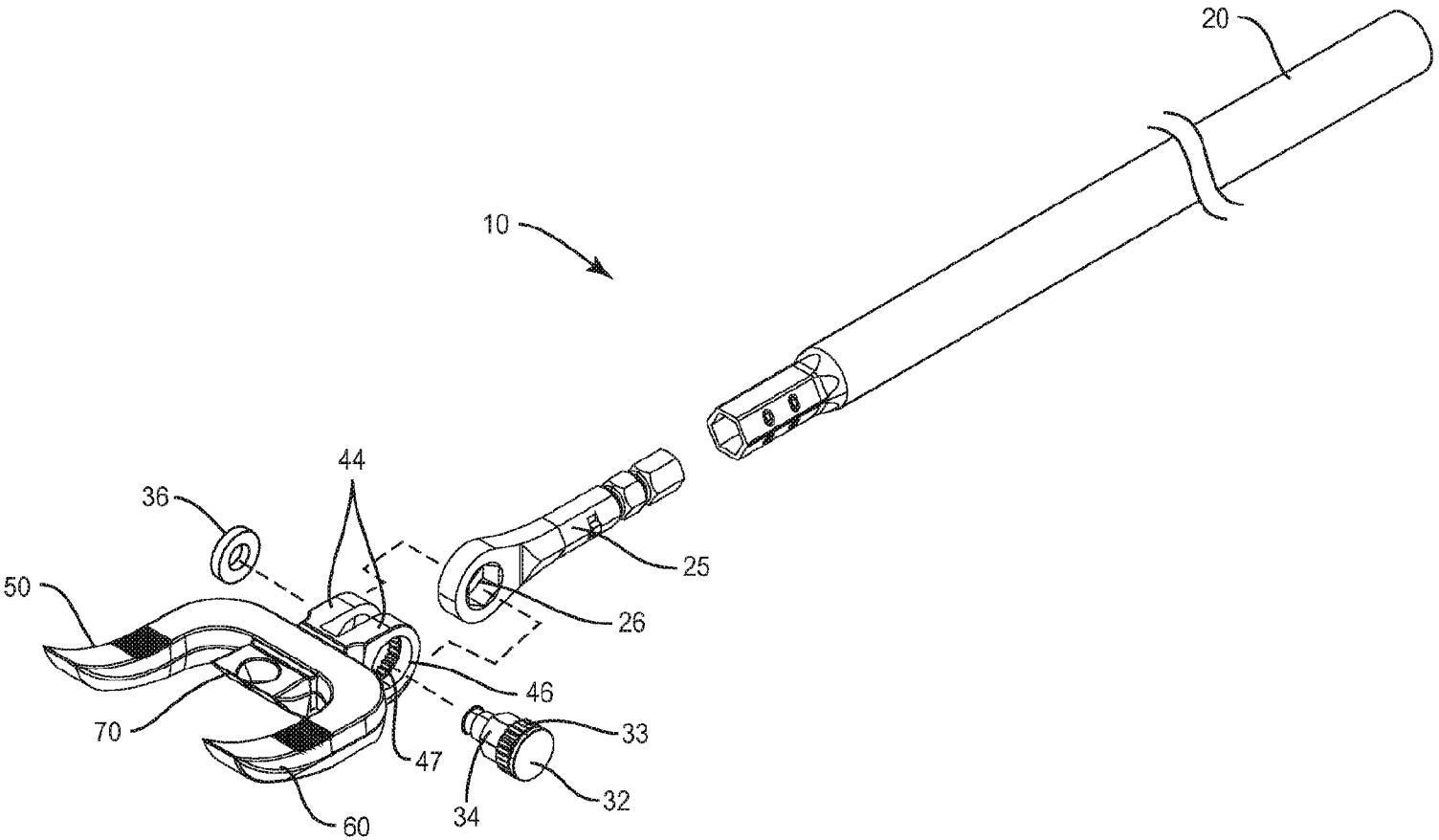
FIG. 2 shows an exploded view of the tool of FIG. 1.

In some embodiments, the head 40 may be fixedly mounted to, or formed integrally with, the distal section 24 of the handle 20, so as to render the head 40 fixed and immovable relative to the handle 20. In other embodiments, the connection between the handle 20 and the head 40 is advantageously via a locking pivot mechanism 30 so that the head 40 may be variably positioned relative to the handle 20, with the angle $\alpha$ between the head axis 42 and the handle longitudinal axis 21 being selectively variable. See FIGS. 6-7. This angle $\alpha$ is advantageously variable over a range of at least from about 80° to about 270°, more advantageously at least from about 45° to about 270°, and more advantageously at least from about 45° to about 315°. In some embodiments, the angle $\alpha$ may be lockable at any infinitely variable value within the range of motion. In other embodiments, the angle $\alpha$ may be lockable only at selected discrete values within the range of motion, such as at about fifteen different values, which may be evenly spaced apart or not. The pivot mechanism 30 may take any suitable form, such as a combination of a threaded bolt and fastener (e.g., wing nut) that can be selectively tightened to lock the head 40 in a desired angular relationship relative to the handle 20, or loosened to allow relative pivoting movement. Advantageously, however, the pivot mechanism 30 is of a more protected locking type, preferably with a push-button actuator. As shown in FIG. 2 and FIG. 3, the head 40 may include two proximal mounting flanges 44, each with a lateral through hole 46 that receives a laterally movable locking pin 32. The two mounting flanges 44 are spaced from each other, so that a distal tang 25 of the handle 20 may extend therebetween. The tang 25 of the handle 20 may likewise include a through hole 26, with a suitable non-circular profile. The locking pin 32 may include teeth 33 thereon that selectively engage with corresponding teeth 47 on one or both of the flange through holes 46, and have a portion 34 that inter-engages with the non-circular profile on the tang through hole 26. A cap 36 may help enclose the locking pin 32. In its normal locked position, the lock pin 32 is rotatably coupled to both the tang 25 and one or both mounting flanges 44. When laterally displaced to its unlocked position, the lock pin 32 becomes rotationally decoupled from the tang 25 and/or both mounting flanges 44, thereby allowing the head 40 to be moved to a different angular position relative to the handle 20. As can be appreciated, the locking pin 32 is advantageously biased toward its locked position, such as by a suitable spring (not shown).

In general, the board removal tool 10 may be made from any suitable materials known in the art of demolition tools. For example, the handle 20 may be fiber reinforced plastic or metal, and the head 40 is advantageously made from hardened steel, as discussed above. In some embodiments, the arms 50,60 are spaced from each other so that the inboard surfaces of their distally extending sections 59,69 are spaced approximately three and one-eighth inches apart, and/or the distally extending sections 59,69 may have a lateral dimension of approximately three fourths of an inch, and/or the central boss 70 may have a lateral dimension of approximately one and one-half inches, so that the tool is conveniently sized for typical applications using so-called "2 by" boards. Of course, other dimensions may alternatively be used if desired.

The board removal tool 10 may be used for removal of boards for deck deconstruction, siding removal, pallet deconstruction, roofing work, and similar demolition activities. For example, the main fastener puller 80 may be used to start or complete the extraction of fasteners so that associated building components may be disassembled more easily. Further, the distal tips 51,61 of the arms 50,60 may be used to pry boards and other materials upward by pulling downward on the handle 20, or vice versa. In some embodiments, the underside of the central boss 70 provides a cam surface 74 to aid in prying. Further, for some embodiments, the optional textured areas 54,64 on the arms 50,60 may better grip the boards (or other components) being removed during the demolition process, to prevent them from slipping off the arms 50,60. Thus, when a board is pried loose, it can be lifted by the arms 50,60 and supported more securely by the textured areas 54,64 as it is lifted and maneuvered (e.g., flipped/tossed aside).

For fastener extraction, the optional fastener pullers 52,62 on the distal tips 51,61 of arms 50,60, if present, may be used for starting (and/or completing) the extraction of fasteners; however, the presence of the main fastener puller 80 provides some advantages. In particular, the location of the main fastener puller 80 in lateral alignment with the handle 20 allows the user to start (and/or complete) the extraction of nails and other fasteners in a way that minimizes lateral torque on the handle 20 during this process. For example, when a user pushes downward on the handle 20, the head 40, and thus the main fastener puller 80, is rotated on lower surface 74 of central boss 70. This rotation of the head causes the main fastener puller 80 to move upward against the resisting force retaining the fastener. By aligning these forces generally along the longitudinal axis 21, the user is not required to counteract twisting torque on the handle 20 that would be otherwise induced if the resisting force were significantly off-line from the longitudinal axis 21. Further, for some embodiments, the presence of the central boss 70 likewise helps minimize lateral torque during the prying/pulling process by providing a common, aligned, fulcrum location.

Figure 8:
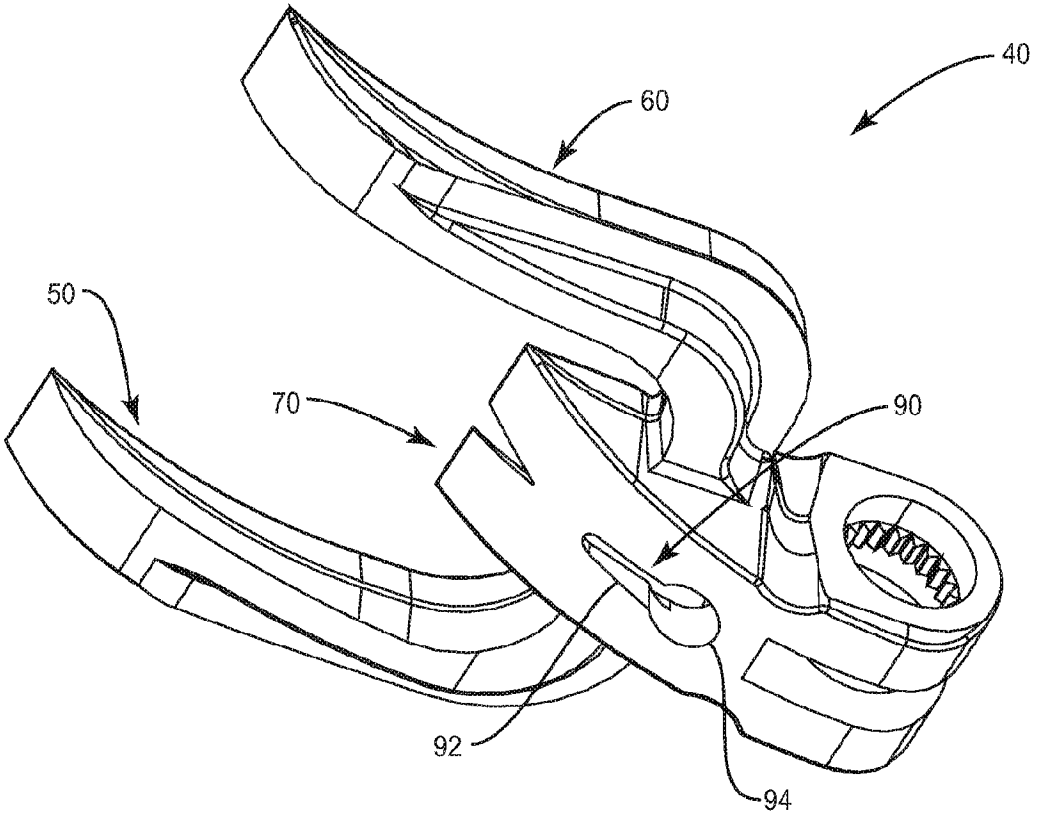
FIG. 8 shows an alternative head for the tool, with an optional rear-entry secondary nail puller on the underside of the central boss.

In some embodiments, the central boss 70 may optionally include a secondary fastener puller 90. See, for example, FIG. 8. This secondary fastener puller 90 is advantageously disposed on the central boss in a location rearward and lower than the main fastener puller of the central boss 70, but also in lateral alignment with longitudinal axis 21. The secondary fastener puller 90 includes an interior recess 92 and an associated slot 94 formed in the lower surface 74 of the central boss 70. Note that the slot 94 opens generally in the rearward or proximal direction P to facilitate entry of the fastener head from the rear. The secondary fastener puller 90 may be used to access fasteners close to adjacent boards. Using main fastener puller 80, a user of the tool 10 may not be able to access the fastener due to the arms 50,60 hitting an adjacent board or other obstruction before the fastener can be engaged. However, if the user rotates the arms 50,60 upward, over the adjacent board/obstruction, the user may then be able to access the fastener via the secondary fastener puller 90 on the underside of the central boss 70. The fastener may then be pulled out by pushing upward/forward on the handle 20.

Note that the secondary fastener puller 90, if present, allows entry of the fastener head into the recess 94 of the secondary fastener puller 90 from the rear, rather than from the front, thereby increasing versatility of the tool 10. Further still, for embodiments of the tool 10 having a pivoting connection between the handle 20 and the head 40, the pivoting connection allows a user to extract fasteners and/or pry from many different angles and positions. Consequently, in one or more preferred embodiments, the two fastener pullers 80, 90 and the adjustable handle to head angle $\alpha$ provide a very versatile tool 10 that allows a user to extract fasteners from many different angles and positions and allows the user to customize the tool 10 for a preferred direction of force to be applied to the handle 20 relative to the user's body that is best for the user and the specific application.

The discussion above has generally been in the context of the main fastener puller 80 being located on a central boss 70 disposed between the outer arms 50,60. However, such is not required in all embodiments. Instead, the main fastener puller 80 may be located on a different portion of the head 40. For example, the head may not have a central boss 70, and the two lateral sections 58,68 of the arms 50,60 may directly join to each other, and the main fastener puller 80 may be located at this juncture. Note that, regardless of the presence or absence of a central boss 70, the main fastener puller 80 has a distally opening entry (e.g., slot 84), and is disposed in general lateral alignment with the longitudinal axis 21 of the handle 20. Note that the main nail puller 80 may be disposed at a different vertical height relative to the arms 50,60, such as above or below a theoretical plane defined by the distally extending sections 59,69, but is advantageously at approximately the same general vertical height as the arms 50,60.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A demolition tool, comprising:

a handle having a proximal portion and a distal portion;

a head mounted to the distal portion of the handle, the head comprising:

first and second distally extending arms that are laterally spaced from each other;

a central boss disposed between the first and second arms, and disposed in lateral alignment with the handle; the central boss having a convexly curved underside surface that extends below the first and second arms, the curved underside providing a prying surface;

a first forward fastener puller disposed at the central boss; the first forward fastener puller having an entry slot that opens distally and is closed proximally;

wherein the first and second arms include laterally extending sections that extend toward the central boss;

wherein the central boss is configured to extend distally such that an uppermost surface of the central boss proximate the entry slot does not extend above the first and second arms such that the uppermost surface of the central boss proximate the entry slot is not visible in side view;

wherein the first forward fastener puller is laterally aligned with the handle; and wherein the central boss is fixed relative to the first and second arms.

2. The demolition tool of claim 1, wherein the central boss is configured such that the entirety of the uppermost surface of the central boss, from a forwardmost tip proximate the entry slot to a juncture with the laterally extending sections of the first and second arms, is not visible in side view.

3. The demolition tool of claim 1, wherein the underside surface of the central boss is continuously curved, when viewed in side view, from distal to the laterally extending sections to proximal to the laterally extending sections.

4. The demolition tool of claim 1, wherein the first and second arms extend distally farther than the central boss.

5. The demolition tool of claim 1, wherein:

the first forward fastener puller comprises an upwardly open cavity disposed proximally relative to the entry slot and accessible by a fastener via the entry slot;

the entry slot has upwardly divergent sides.

6. The demolition tool of claim 1, wherein the first and second arms both include elongate recesses on their lower outboard sides.

7. The demolition tool of claim 1:

wherein the first arm has a second fastener puller on its distal tip;

wherein the second arm has a third fastener puller on its distal tip.

8. The demolition tool of claim 1, wherein the underside of the first and second arms are both convexly curved.

9. The demolition tool of claim 1, wherein the first and second arms both include a textured section for increased gripping on an upper surface thereof.

10. The demolition tool of claim 1:

wherein the first forward fastener puller comprises an upwardly open cavity, and wherein the entry slot has upwardly divergent sides;

wherein the first and second arms include laterally extending sections that extend toward the central boss, and the first and second arms extend distally farther than the central boss;

wherein the underside surface of the central boss is continuously curved, when viewed in side view, from distal to the laterally extending sections to proximal to the laterally extending sections;

wherein the head is movably mounted to the distal portion of the handle by a pivot connection that is operative to lockably position the head at a desired angular position relative to a longitudinal axis of the handle;

wherein the first and second arms both include a textured section for increased gripping on an upper surface thereof.

11. The demolition tool of claim 1, wherein the central boss and first and second arms are integrally formed as a unitary body such that the central boss is fixed relative to the first and second arms.

12. A demolition tool, comprising:

a handle having a proximal portion and a distal portion;

a head mounted to the distal portion of the handle, the head comprising:

first and second distally extending arms that are laterally spaced from each other;

a central boss disposed between the first and second arms, and disposed in lateral alignment with the handle; the central boss having a convexly curved underside surface that extends below the first and second arms, the curved underside providing a prying surface;

a first forward fastener puller disposed at the central boss; the first forward fastener puller having an entry slot that opens distally and is closed proximally;

wherein the first and second arms include laterally extending sections that extend toward the central boss;

wherein the central boss is configured to extend distally such that an uppermost surface of the central boss proximate the entry slot does not extend above the first and second arms such that the uppermost surface of the central boss proximate the entry slot is not visible in side view;

wherein the first forward fastener puller is laterally aligned with the handle; and wherein the central boss further comprises a secondary rearward nail puller on an underside thereof.

13. A demolition tool, comprising:

a handle having a proximal portion and a distal portion;

a head mounted to the distal portion of the handle, the head comprising:

first and second distally extending arms that are laterally spaced from each other;

a central boss disposed between the first and second arms, and disposed in lateral alignment with the handle; the central boss having a convexly curved underside surface that extends below the first and second arms, the curved underside providing a prying surface;

a first forward fastener puller disposed at the central boss; the first forward fastener puller having an entry slot that opens distally and is closed proximally;

wherein the first and second arms include laterally extending sections that extend toward the central boss;

wherein the central boss is configured to extend distally such that an uppermost surface of the central boss proximate the entry slot does not extend above the first and second arms such that the uppermost surface of the central boss proximate the entry slot is not visible in side view;

wherein the first forward fastener puller is laterally aligned with the handle; and wherein the head is movably mounted to the distal portion of the handle by a pivot connection that is operative to lockably position the head at a desired angular position relative to a longitudinal axis of the handle.

14. The demolition tool of claim 13, wherein the pivot connection includes a push button actuator.

15. The demolition tool of claim 13, wherein the central boss is configured such that the entirety of the uppermost surface of the central boss, from a forwardmost tip proximate the entry slot to a juncture with the laterally extending sections of the first and second arms, is not visible in side view.

16. The demolition tool of claim 13, wherein the underside surface of the central boss is continuously convexly curved, when viewed in side view, from distal to the laterally extending sections to proximal to the laterally extending sections.

17. The demolition tool of claim 13, wherein the first and second arms extend distally farther than the central boss.

18. The demolition tool of claim 13, wherein the first and second arms both include elongate recesses on their lower outboard sides.

19. The demolition tool of claim 13:

wherein the first arm has a second fastener puller on its distal tip;

wherein the second arm has a third fastener puller on its distal tip.

20. The demolition tool of claim 13, wherein the first and second arms both include a textured section for increased gripping on an upper surface thereof.

* * * * *